US005177885A

United States Patent [19]

Marmonnier

[11] Patent Number: 5,177,885

[45] Date of Patent: Jan. 12, 1993

[54] DEVICE FOR CLOSING AND FOR CLAMPING A SKI BOOT AND SKI BOOT THUS EQUIPPED

[75] Inventor: Gilles Marmonnier, Saint Etienne De Crossey, France

[73] Assignee: Skis Rossignol S.A., Saint Etienne De Crossey, France

[21] Appl. No.: 745,190

[22] Filed: Aug. 15, 1991

[30] Foreign Application Priority Data

Aug. 28, 1990 [FR] France ..... 90 10920

[51] Int. Cl.[5] ..... A43B 5/04

[52] U.S. Cl. ..... 36/117; 36/120

[58] Field of Search ..... 36/117-121

[56] References Cited

U.S. PATENT DOCUMENTS

| | | | |
|---|---|---|---|
| 4,083,129 | 4/1978 | Collombin et al. | 36/117 |
| 4,619,057 | 10/1986 | Sartor | 36/117 X |
| 4,669,202 | 6/1987 | Ottieri | 36/120 |
| 4,694,592 | 9/1987 | Baggio et al. | 36/117 |
| 4,922,635 | 5/1990 | Zanco | 36/117 X |
| 4,949,480 | 8/1990 | Hercog et al. | 36/117 X |

FOREIGN PATENT DOCUMENTS

| | | | |
|---|---|---|---|
| 0053340 | 6/1982 | European Pat. Off. . | |
| 0144100 | 6/1985 | European Pat. Off. | 36/117 |
| 0281544 | 9/1988 | European Pat. Off. . | |
| 2540359 | 8/1984 | France . | |
| 2632871 | 12/1989 | France . | |

*Primary Examiner*—Paul T. Sewell
*Assistant Examiner*—Ted Kavanaugh
*Attorney, Agent, or Firm*—Parkhurst, Wendel & Rossi

[57] ABSTRACT

Device for closing and clamping a ski boot, in which:
a collar (20) is articulated at (22) in the sole (7);
the saddle (30) articulated (31) on the collar (20) comprises a finger (34) which takes its bearing on a ramp (10) formed in the sole (7);
the collar (20) interacts with a lever (40), in which there is formed a slot (41), in which there comes to be accommodated and to slide the end (42) of a rigid arm (43) fixed at its other end (45) to the shell (1);
the assembly includes a flexible cable (50) connecting via the end the lateral faces of the collar by passing via the free end of the lever.

5 Claims, 6 Drawing Sheets

DEVICE FOR CLOSING AND FOR CLAMPING A SKI BOOT AND SKI BOOT THUS EQUIPPED

The invention relates to a device for clamping and for closing a ski boot made of plastic material; it also relates to rear-entry ski boots thus equipped.

As is known, a ski boot essentially comprises:

- a rigid shell which is intended to receive an inner boot, which in turn receives a foot of the skier, and which comprises a sole and a heel;
- a collar which is intended to enclose the bottom of the leg and consists, possibly, of two cuffs which are deflectably articulated in relation to the shell, generally on the shell itself, and interconnected by hooks, buckles or similar means;
- lastly, means for clamping and for retaining the foot in the shell and for clamping the collar on the leg, such as hooks, racks, buckles, knurls, cables or other means.

Although widespread, these ski boots have the disadvantage of not always being easy to use, in particular by children or women, more especially in the cold, because of the difficulty of gripping the clamping means. Furthermore, use is also made difficult by the complexity of the method of use (a number of levers, buttons etc.).

There has been known for a short time a rear-entry boot of the type in question, which has good lateral rigidity and which comprises a rigid lateral reinforcement saddle in the shape of a U, the two branches of which are arranged on each lateral face of the shell and are, in the locked position, oriented in a general direction which is essentially parallel to that of the tibia, the top of the lateral branches being connected by a connecting portion in the shape of a gutter, so as to follow part of the bottom of the leg. In an advantageous embodiment, the lower free end of the two lateral branches of the saddle is articulated on the bottom of the rear collar.

The invention relates to a device for closing and for clamping this type of ski boot with a saddle serving as buckle, which is easy to operate, reliable, and makes it possible to ensure progressive clamping in one single movement by means of a simplified cable circuit.

This device for closing and for clamping a ski boot comprises:

- a shell which is intended to receive an inner boot, which in turn receives a foot of the skier, and which comprises a sole and a heel, and which has in the region of this heel a support ramp;
- a collar which is intended to enclose the bottom of the leg, articulated in relation to the shell and capable of pivoting towards the rear;
- a saddle, in the shape of a gutter and serving as buckle, which is articulated in relation to the collar and arranged in the use position in a general direction which is essentially parallel to that of the tibia, following the rear of the collar and surrounding the rear of the bottom of the leg and the top of the heel.

This ski boot is characterized in that the collar, which is articulated in the sole of the shell at the height of the plantar arch, comprises at the rear an articulated lever, in which a slot is formed, in which there comes to be accommodated and to slide the end of a rigid arm which is fixed at its end to the rear of the shell;

in that the saddle articulated on the collar comprises at its lower end a finger which takes its bearing on the ramp formed in the shell and itself has another ramp formed inside the connecting portion in the shape of a gutter;

and lastly in that the assembly comprises a flexible cable connecting the front of the boot to the free end of the lever, passing, in the collar, via deflectors.

Thus, during the closing operation, by action on the saddle, the collar pivots in order to put itself in position by action of the finger sliding on the ramp. By virtue of the rigid arm connecting shell and lever, the characteristic lever pivots towards the bottom about its pin, thus keeping the cable tensioned, and this ensures the closing operation. Continuing the movement, the lever then comes to take its bearing on the ramp provided to this end inside the connecting portion of the branches of the saddle in order thus to be pivoted completely towards the bottom and towards the front of the shell, which then ensures the clamping of the bottom of the collar on the bottom of the leg.

Advantageously, in practice:

the ramp formed in the saddle is, when this saddle is in the high position, known as the use position, inclined towards the bottom and towards the front of the boot and ends in a hook in which there comes to be accommodated, in the locked position, the free end of the lever in order to ensure the self-locking of the assembly and the retention of the saddle;

in the locked position, the cable passes in front of the articulation pin of the lever on the collar;

the collar is made in two separate parts, respectively a rear cuff articulated, as already mentioned, in the sole at the height of the plantar arch, and a front cuff which is then articulated on this rear cuff, in front of the malleoli;

the rear articulated cuff comprises two separate portions, respectively a top portion forming the collar proper and enclosing the bottom of the leg, connected to a bottom portion which forms a stirrup and encloses the rear of the heel and which according to a characteristic of the invention is articulated in the sole.

The manner in which the invention can be produced and the advantages which derive therefrom will emerge more clearly from the exemplary embodiment which follows, supported by the attached figures.

Figure 2:
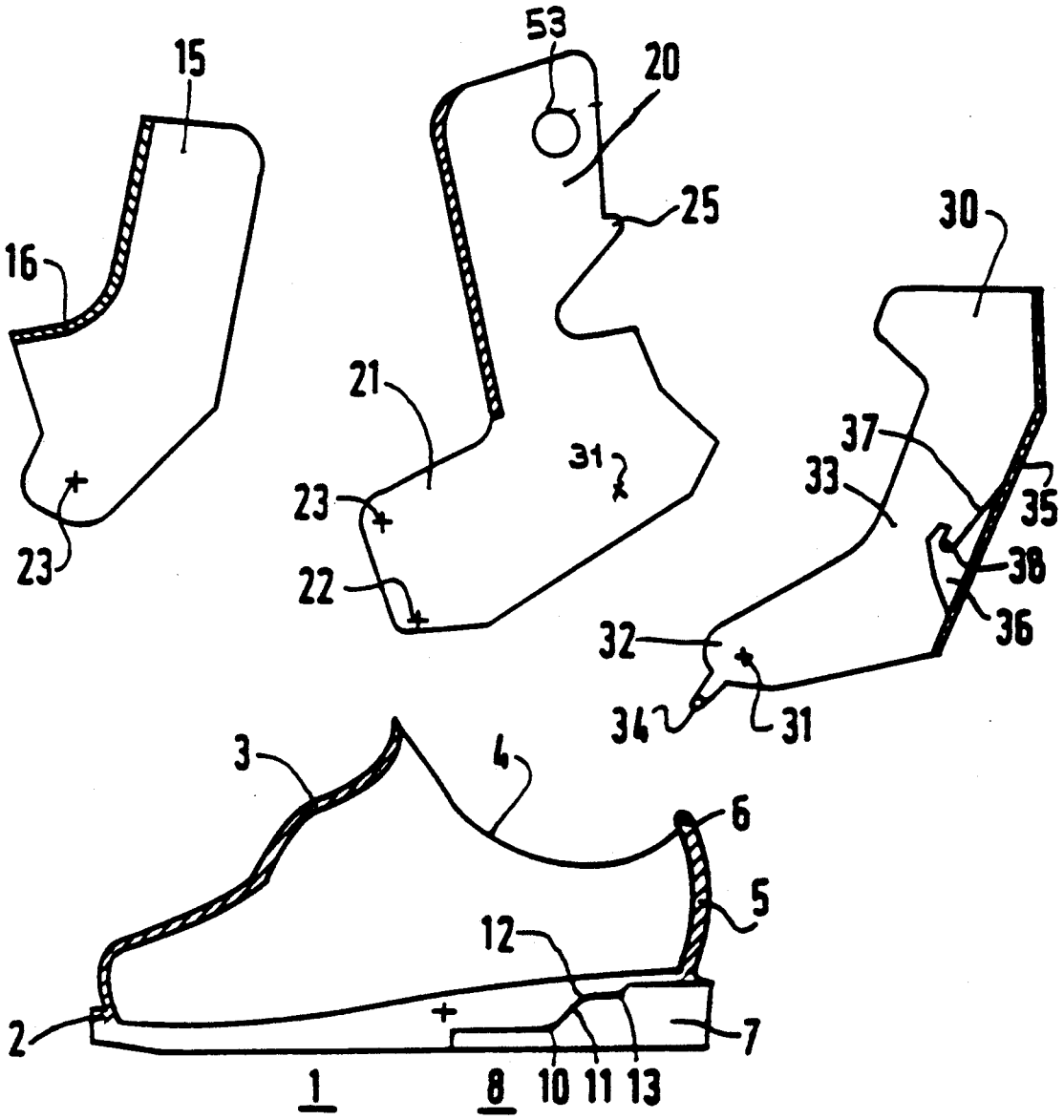
FIG. 2 is a concise exploded representation of the essential parts of the boot, excluding the specific closing assembly.

The ski boot according to the invention essentially comprises (see FIG. 2):

firstly, a shell made of rigid plastic material and designated by the general reference (1), which has in order a toe (2), an instep (3), an indentation (4), a rear face (5) starting at the height (6) of the calcaneus and a sole (7) which has at the height of the heel, more precisely in the portion (8) comprised between the plantar arch and the heel, a ramp (10) formed to begin with by a first gradually increasing portion (11) connected to a rounded peak (12) forming a high point, then to a second portion (13), the slope of which is flatter than the first portion (11). This characteristic ramp (10) is monobloc and is obtained at the time of moulding of the shell (1) or of the wear piece protecting the shell.

In known manner, the boot according to the invention comprises an articulated collar which can pivot towards the rear and is made in two parts, respectively a front cuff (15), the bottom of the front face (16) of which is arranged above the instep (3). This front cuff (15) interacts in known manner with a rear cuff (20) which, according to a characteristic of the invention, has on either side of the shell (1) an extension designated by the general reference (21). According to another characteristic of the invention, the rear cuff (20) is articulated on either side in the region of its extension (21), and more precisely about an axis (22) arranged in the sole (7) of the shell at the height of the plantar arch.

According to a third characteristic of the invention, the front cuff (15) is articulated at (23) on the extension (21) of the rear cuff (20), this axis (23) being arranged in front of the malleoli.

The boot also comprises a saddle designated by the general reference (30), which is articulated on the extension (21) of the rear cuff (20) about an axis (31) arranged behind the malleoli. According to a characteristic of the invention, the lower end (32) of each branch (33) of the saddle has on either side of the shell a finger (34) intended to take its bearing on the characteristic ramp (10). Moreover, the inside of the rear connecting portion (35) in the shape of a U of the saddle (30) has a second ramp (36) which is inclined (37) towards the bottom and to the front of the boot and ends in a hook (38).

Figure 3:
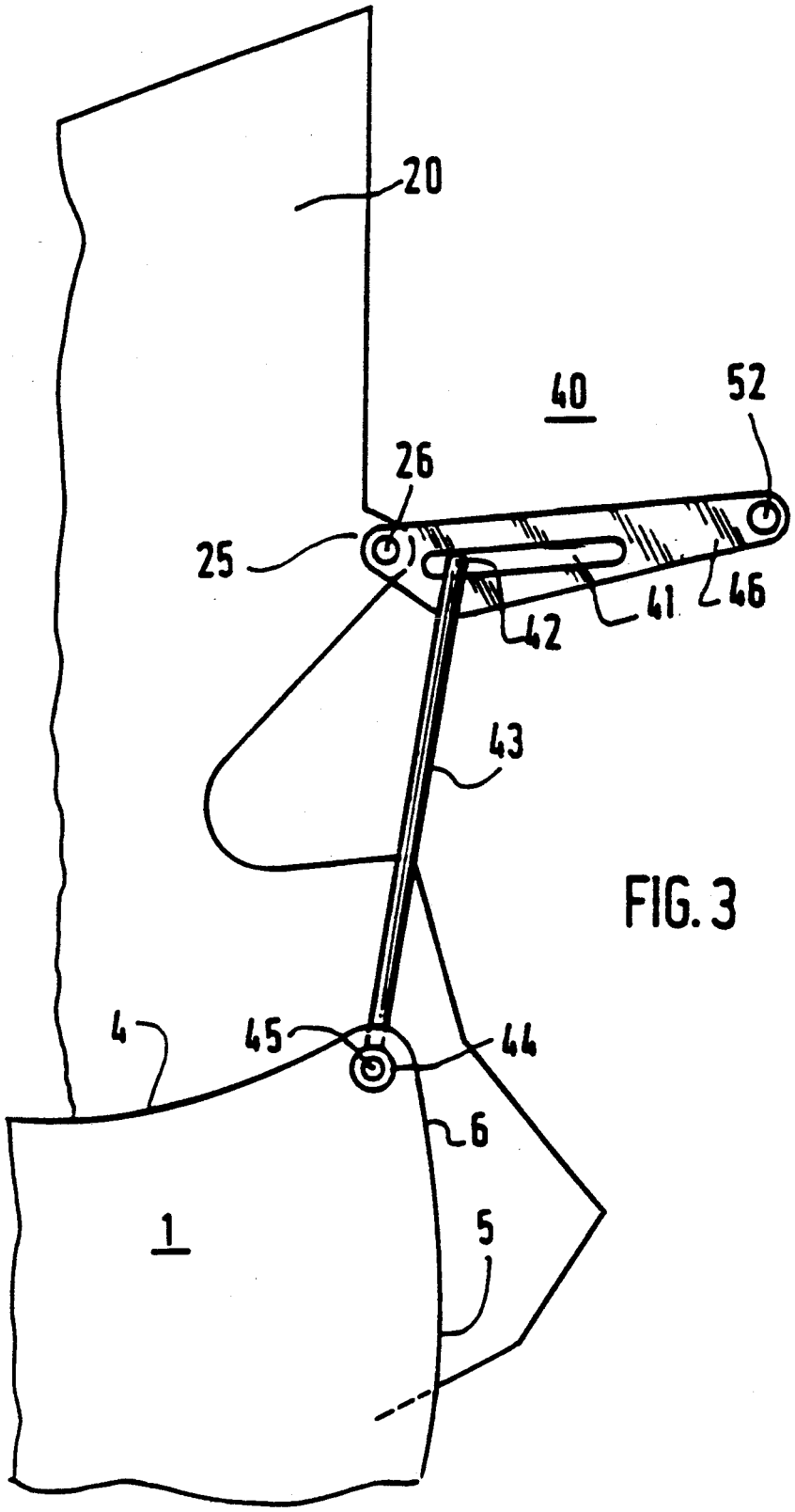
FIG. 3 is a concise representation of this characteristic closing device.

According to another essential characteristic of the invention (see FIG. 3), the rear cuff (20) has at the rear and in its center (25) a pin (26), on which there comes to be articulated a lever designated by the general reference (40), in which there is formed a slot (41), in which there comes to be accommodated and to slide the end (42) of a rigid arm (43), made of steel for example, which is articulated at its other end (44) about a pin (45) arranged on the shell (1) in the region of the calcaneus (6).

A cable (50) in common use for these applications is fixed by its ends at (51) and (51*a*) on the front cuff (15) and passes at (52) to the free end of the lever (40), passing via deflectors (53) formed to this effect in the rear cuff (20).

The boot also comprises in known manner members (not shown) for retaining the foot and the heel in the shell.

Figure 1:
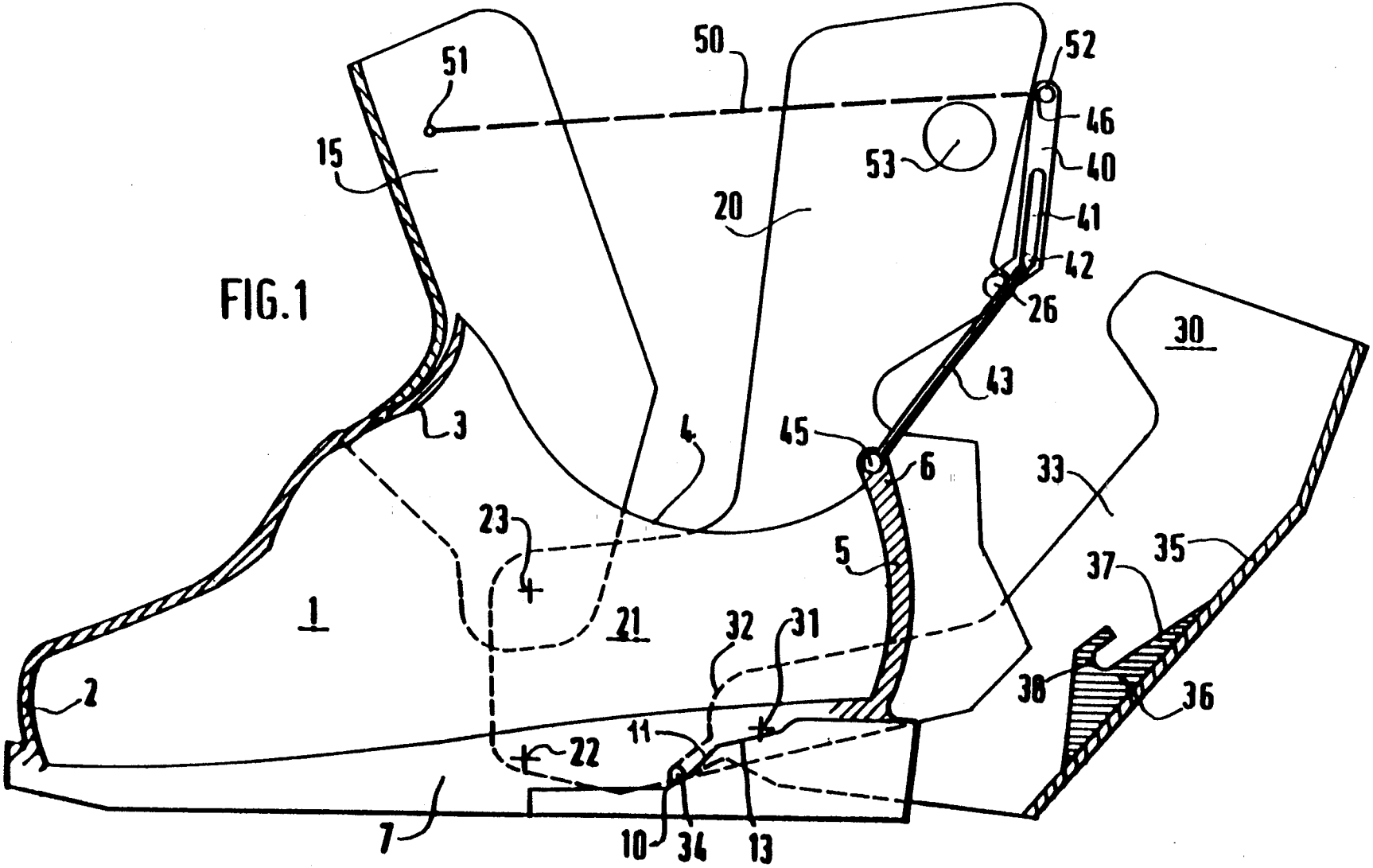
FIG. 1 is a concise representation in cross-section section of an open rear-entry ski boot according to the invention.

When the boot is in the open position (FIG. 1), the saddle (30) is pivoted towards the bottom about the axis (31), the finger (34) is in the most advanced position possible towards the toe (2) on the ramp (10), and the collar is in a position pivoted towards the rear.

Figure 4:
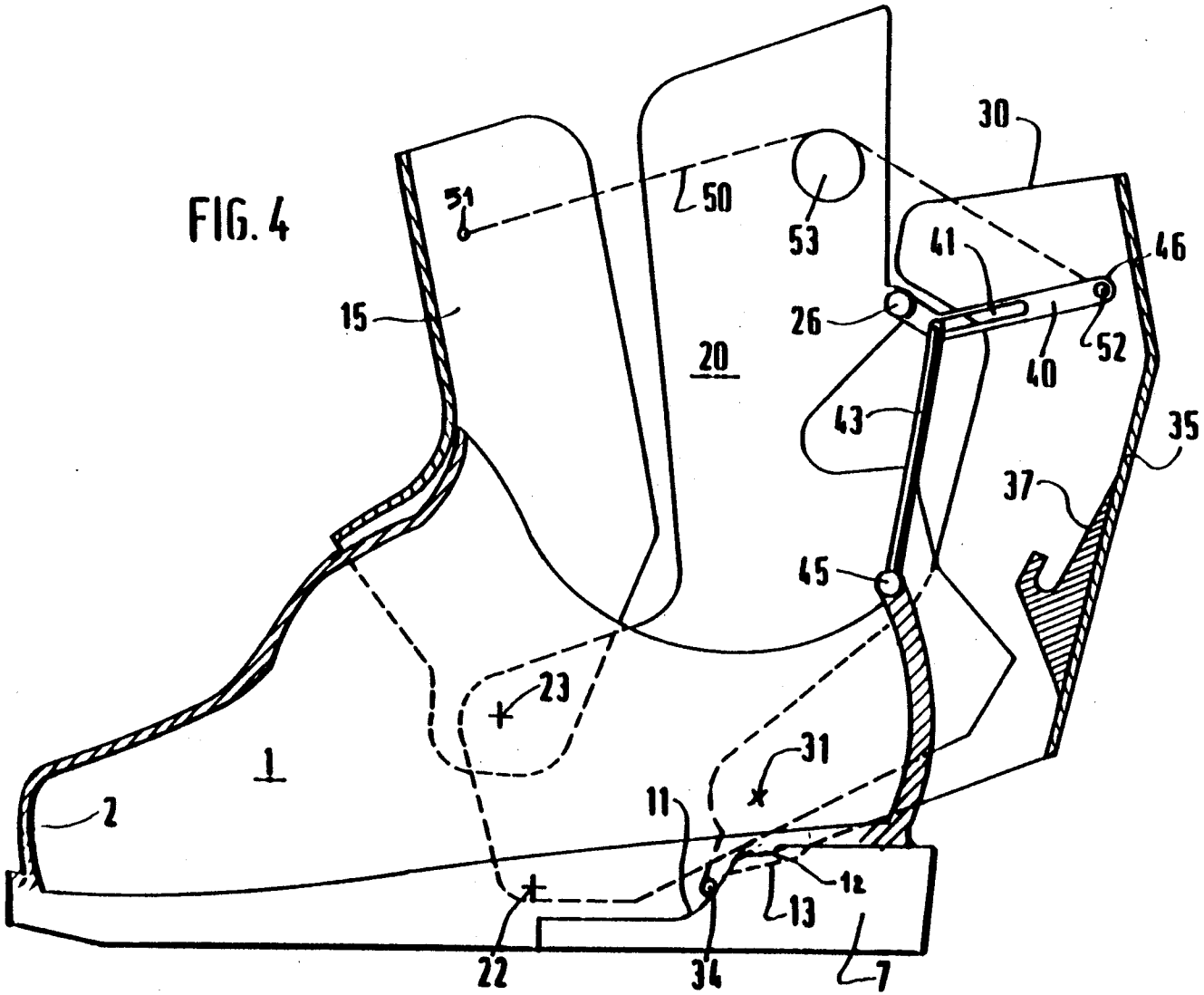
FIGS. 4, 5 and 6 show the boot according to the invention in intermediate positions, respectively low (FIG. 4), high (FIG. 5), and closed (FIG. 6).
Figure 5:
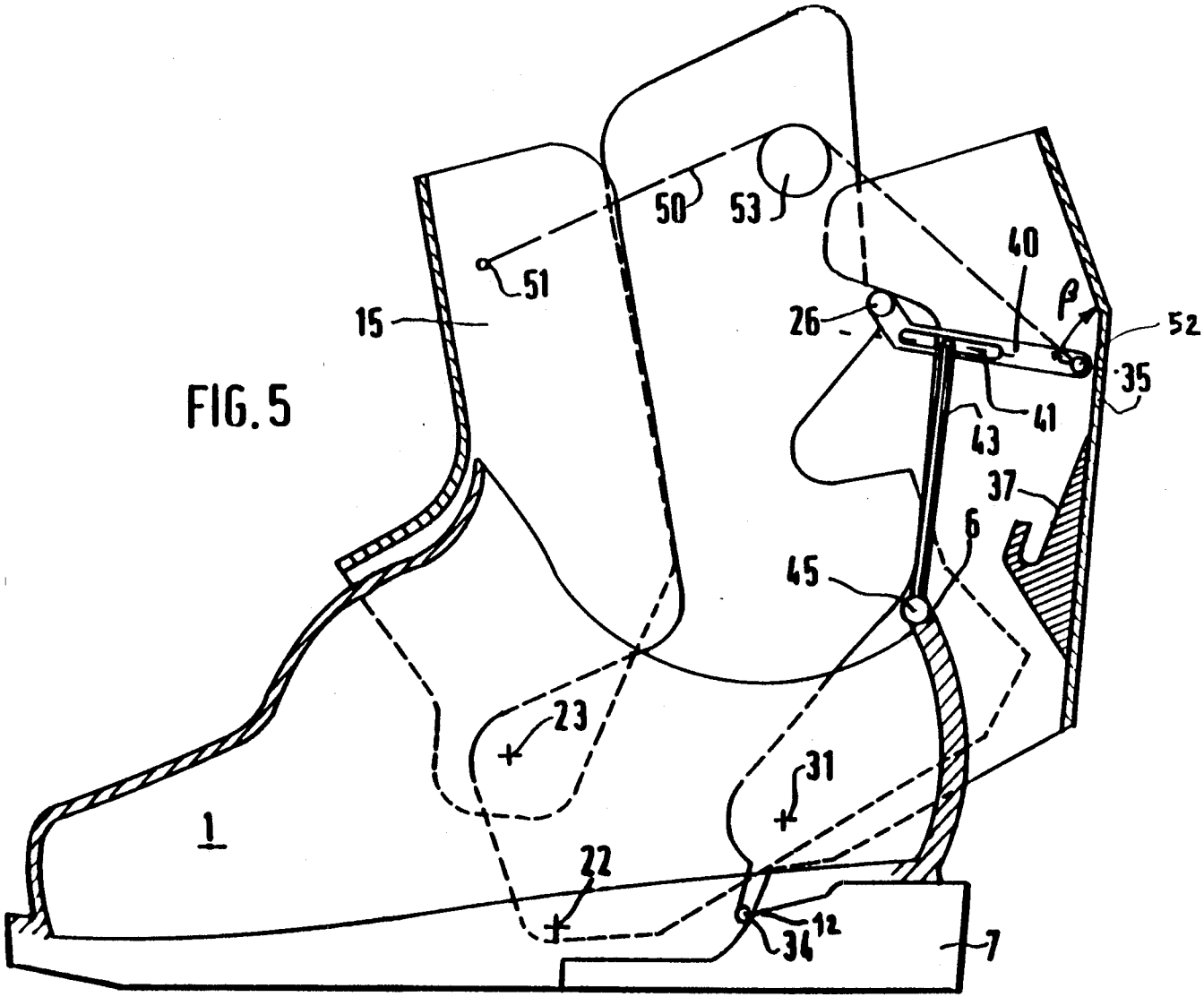

When the skier has put the boot on and wants to close the boot, he pushes the saddle (30) towards the front and towards the top. In doing this, the saddle pivots about its axis (31) and the finger (34) rises on the first portion of the ramp (11) by lever effect. This has the effect of drawing the rear cuff (20) into pivoting about the axis (22) as a result of the displacement of the axis (31) towards the top. During this movement, the rigid arm (43) of constant length exerts a force on the lever (40), which makes it pivot towards the bottom about its pin (26), which has the effect of keeping the cable (50) tensioned (see FIG. 4). When the collar (20) arrives in the high position, that is to say when the finger (34) arrives on the peak (12) of the ramp (10), the end (52) of the lever (40), via which the flexible cable (50) passes, touches the connecting portion (35), (see FIG. 5).

It is important that the angle $\beta$ (see FIG. 5) formed between the axis of the lever (40) and this connecting portion (35) is less than 90° in order to pass the point of equilibrium and to be able to continue its movement.

Figure 6:
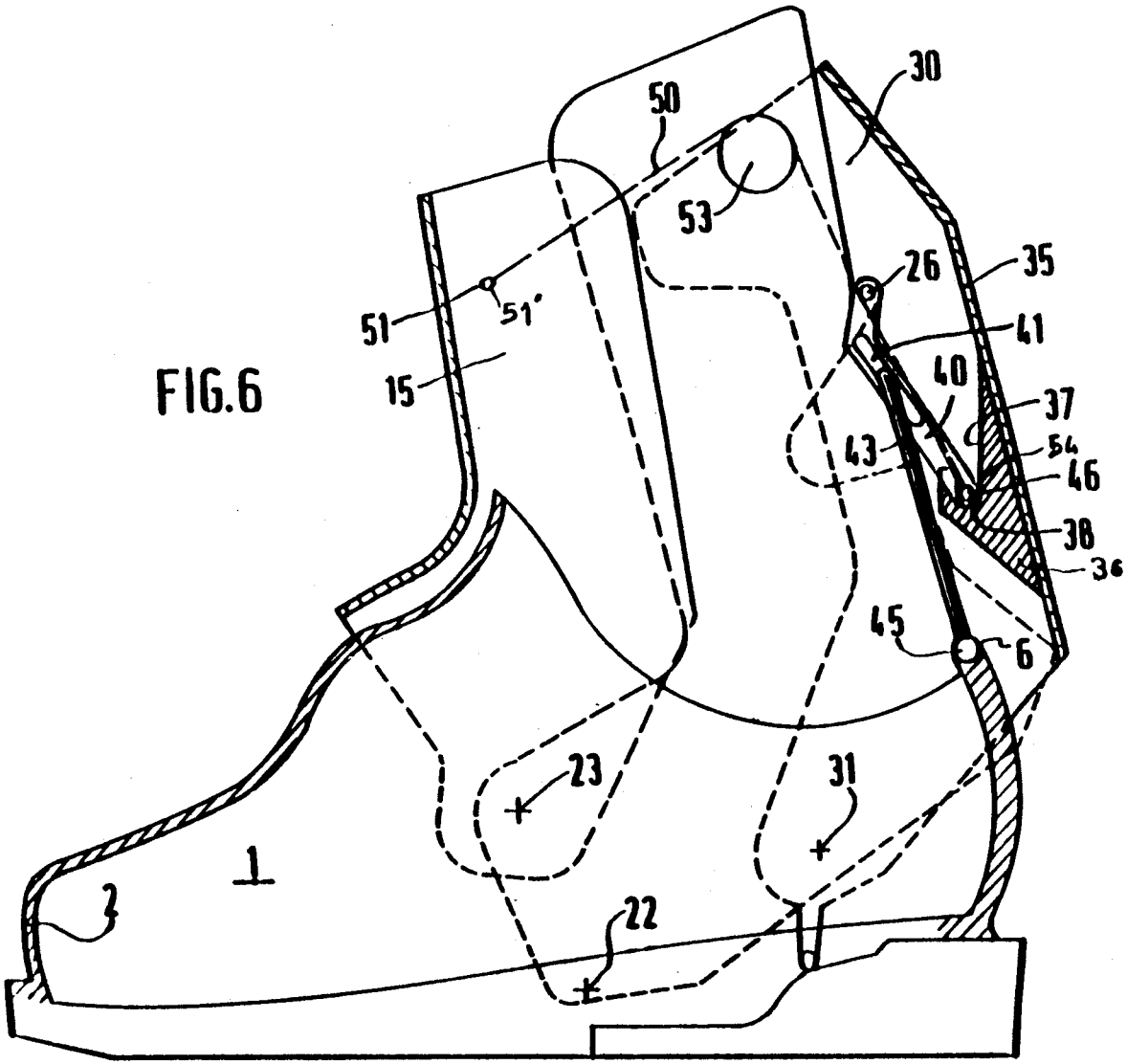

By continuing the movement on the saddle (see FIG. 6), the free end (54) of the lever (40), in which the cable (50) passes, slides along the ramp (36, 37) until it comes to be accommodated in the hook (38). It is important that in this position the cable (50) comes below the articulation pin (26) of the lever on the rear of the rear cuff (20), in order to ensure the irreversibility of this position.

When the end (46) of the lever (40) is in the characteristic hook (38), the saddle is self-locked and is kept in this position.

Although in the preferred exemplary embodiment described the collar is made in two parts, it goes without saying that, without leaving the scope of the invention, this collar can also be made in one single piece which is articulated towards the rear. In this case, the cable (50) surrounds the bottom of the leg over the flaps of the collar.

The boot is thus perfectly closed and clamped on the bottom of the leg of the skier.

This arrangement, which is simple to manufacture, is characterized by a larger opening, a simplified cable (50) circuit and, above all, it makes possible good closing and perfect clamping by means of a single movement.

I claim:

1. Device for closing and clamping a ski boot, of the type comprising:

a shell (1) which is intended to receive an inner boot, which in turn receives a foot of the skier, and which comprises a sole (7) and a heel, and which has in the region of this heel a support ramp (10);

a collar (20) which is intended to enclose the bottom of the leg and capable of pivoting towards the rear in relation to the shell (1);

a saddle (30), in the shape of a gutter and serving as buckle, which is articulated in relation to the collar (20) and arranged in the use position in a general direction which is essentially parallel to that of the tibia, following the rear of the collar and surrounding the rear (5) of the bottom of the leg and the top (6) of the heel, wherein the collar (20), which is articulated in the sole (7) of the shell (1) at the height of the plantar arch, comprises at the rear an articulated lever (40), in which a slot (41) is formed, in which there comes to be accommodated and to slide the end (42) of a rigid arm (43) which is fixed at its other end (45) to the rear of the shell (1);

the saddle (30) articulated on the collar comprises at its lower end (32) a finger (34) which takes its bearing on the ramp (10) formed in the sole (7) and has inside the saddle a connecting portion (35) comprising a second ramp (37, 38);

the assembly comprises a flexible cable (50) connecting the front of the boot to the free end (46) of the lever (40), passing, in the collar (20), via deflectors (53).

2. Device according to claim 1, wherein when the saddle (30) is in its highest or use position, the second ramp (36) formed in the saddle (30) is inclined (37)

towards the bottom and towards the front of the boot, then ends in a hook (38), in which the free end (46) of the lever (40) comes to be accommodated. in a locked position, in order to ensure the self-locking of the assembly and the retention of the saddle (30).

3. Device according to claim 1, wherein in a locked position (FIG. 6), the cable (50) passes in front of the articulation pin (26) of the lever (40) on the collar (20).

4. Device according to claim 1, wherein that the collar (20) is made in two separate parts, respectively a rear cuff (20) articulated (22), as already mentioned, in the sole (7) at the height of the plantar arch, and a front cuff (15) articulated (23) on this rear cuff (20), in front of the malleoli.

5. Device according to one of claim 1, wherein that the rear articulated cuff (.20) comprises two separate portions, respectively a top portion and a bottom portion, the top portion forming the collar proper and enclosing the bottom of the leg, connected to the bottom portion (21) which forms a stirrup and encloses the rear of the heel at (5) and which is articulated at (22) in the sole (7).

* * * * *